US006390212B1

(12) United States Patent
Wood

(10) Patent No.: US 6,390,212 B1
(45) **Date of Patent: *May 21, 2002**

(54) DRILL BIT (B)

(76) Inventor: Roy W. Wood, 119 Persimmon St., Birmingham, AL (US) 35214

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/345,832

(22) Filed: Jul. 1, 1999

(51) Int. Cl.[7] ..... E21B 10/60
(52) U.S. Cl. ..... 175/340; 175/393
(58) Field of Search ..... 125/339, 340, 125/393

(56) References Cited

U.S. PATENT DOCUMENTS 3,923,109 A * 12/1975 Williams, Jr. ..... 175/340
4,083,417 A * 4/1978 Arnold ..... 175/339
4,222,447 A * 9/1980 Cholet ..... 175/340
4,372,399 A * 2/1983 Cork ..... 175/340
5,494,123 A * 2/1996 Nguyen ..... 175/408
5,890,550 A * 4/1999 Swadi et al. ..... 175/408
6,098,728 A * 8/2000 Wells et al. ..... 175/340

* cited by examiner

*Primary Examiner*—William Neuder
(74) *Attorney, Agent, or Firm*—John K. Donaghy

(57) ABSTRACT

A drill bit for drilling into earth formations comprising a plurality of cutting cones and a connecting device to attach a drill bit to a drill string for drilling bore holes and providing a stabilizer for the drill bit in a drill hole and providing a plurality of passage structures to provide and distribute compressed air through the drill string to the drill bit plenum chamber in proportions needed to properly purge cuttings from the bore hole most effectively and maintain stabilization for the drill bit in the drill hole thus providing for longer life expectancy of the drill bit and cutting cones.

7 Claims, 5 Drawing Sheets

DRILL BIT (B)

BACKGROUND OF THE INVENTION

1. Field of invention

This invention pertains to a drill for drilling bores earth into earth formations.

2. Background of prior art

Prior art discloses drill bits attached to a rotary drill system which includes hollow drill strings attached to a drilling device. The hollow drill strings permit passage of either drilling mud or gaseous drilling fluid such as entrained air to the drill bit to function as a medium for conveying the cuttings to the surface. Such drill bits contain openings, nozzles and like for discharging the drilling fluid from the drill bit to and around the surface being drilled to convey dust and cuttings away from the cutting area and the drill bit cones to the surface. Such drill bits are made generally but not restricted to three forged sections, each containing a cutting cone with bearings welded into a unit, then threaded for coupling to a drill string. Openings and nozzles to deliver said fluid means to bore hole are disclosed in U.S. Pat. Nos. 4,540,055; 4,541,494 and 4,727,943 assigned to this inventor.

SUMMARY OF INVENTION

There is an urgent need for a drill bit which can effectively and efficiently function in the drill hole and provide sufficient structure to stabilize the drill bit in the drill hole while drilling. The invention provides a bit structured to a surface which will reduce excess wear on the bearing skirts and multiple openings to effectively deliver pressured fluid to convey the dust and cuttings from the cutting area and the drill bit cones by the bit annular area to the upper terminus of the stabilizer where multiple openings or nozzles are situated to form a fluidized bed in the drill pipe annular area located above the drill bit to convey dust and cuttings to the surface of the drill hole.

It is therefore an object of this invention to provide a drill bit sufficiently self-stabilized to eliminate the need for a bit stabilizer normally threadedly installed between the drill bit and the drill string.

It is yet another object of this invention to install wear resistant inserts and hard surface materials on the cutting cones which further extend the stabilizer useful life.

Another object of this invention is to locate adjustable openings or nozzles in the upper end of the stabilizer which are connected by a port to the plenum chamber of the drill bit.

Another object of this invention is to provide the openings or nozzles to direct the fluid up the annular area around the drill string to provide a fluidized bed to convey cuttings to the surface.

Another object of this invention is to slant the side openings or nozzles tangentially to the left of the bit and direct the center openings or nozzles upwardly and direct the other side openings or nozzles tangential to the right side of the bit to form a fluidized bed to convey dust and cuttings to the surface.

It is yet another object of this invention to locate lower openings or nozzles between each cutting cone and directed them to the bottom of the drill hole to remove dust and cuttings from the cutting cones and from the bottom of the drill hole.

It is yet another object of this invention to arrange the lower openings or nozzles to be ported to the fluid means in the drill bit plenum chamber.

It is yet another object of this invention provides the lower openings or nozzles be adjustable.

Another object of this invention is to arrange that the pressurized fluid delivered through the hollow drill string to the bit plenum chamber and meter it through adjustable lower openings or nozzles to the cutting cone area and the bottom of the drill hole at the volume required for proper velocity to convey the dust and cuttings into the annular area at the top of the drill bit.

It is yet another object of this invention to deliver an additional volume of pressurized fluid medium required to create a fluidized bed in the drill pipe annular member and through the adjustable upper openings or nozzles to maintain up hole velocity to convey dust and cuttings to the surface.

It is yet another object of this invention to utilize the controllable pressurized fluid mediums and volumes required to reduce sand blasting, skirt erosion and matrix metals erosion due to excess volume and velocity of the pressurized fluid medium in the cutting cone and bottom of the bore hole area.

It is yet another object of this invention to change the environment of the drill hole so as to extend the useful life of the drill bit cutting metal members around teeth, bearing skirts and allow for a faster penetration and a cleaner bore hole.

These and other objects of the invention will become apparent to those skilled in the art to which the invention pertains.

It is comprehended that the use of upper and lower openings or nozzles and stabilizer may also be accomplished by extending the lower nozzle body to the threaded coupling of the drill bit with multiple openings or nozzles.

DETAILED DESCRIPTION OF THE PREFERRED EMBODIMENT OF THIS INVENTION

Figure 1:
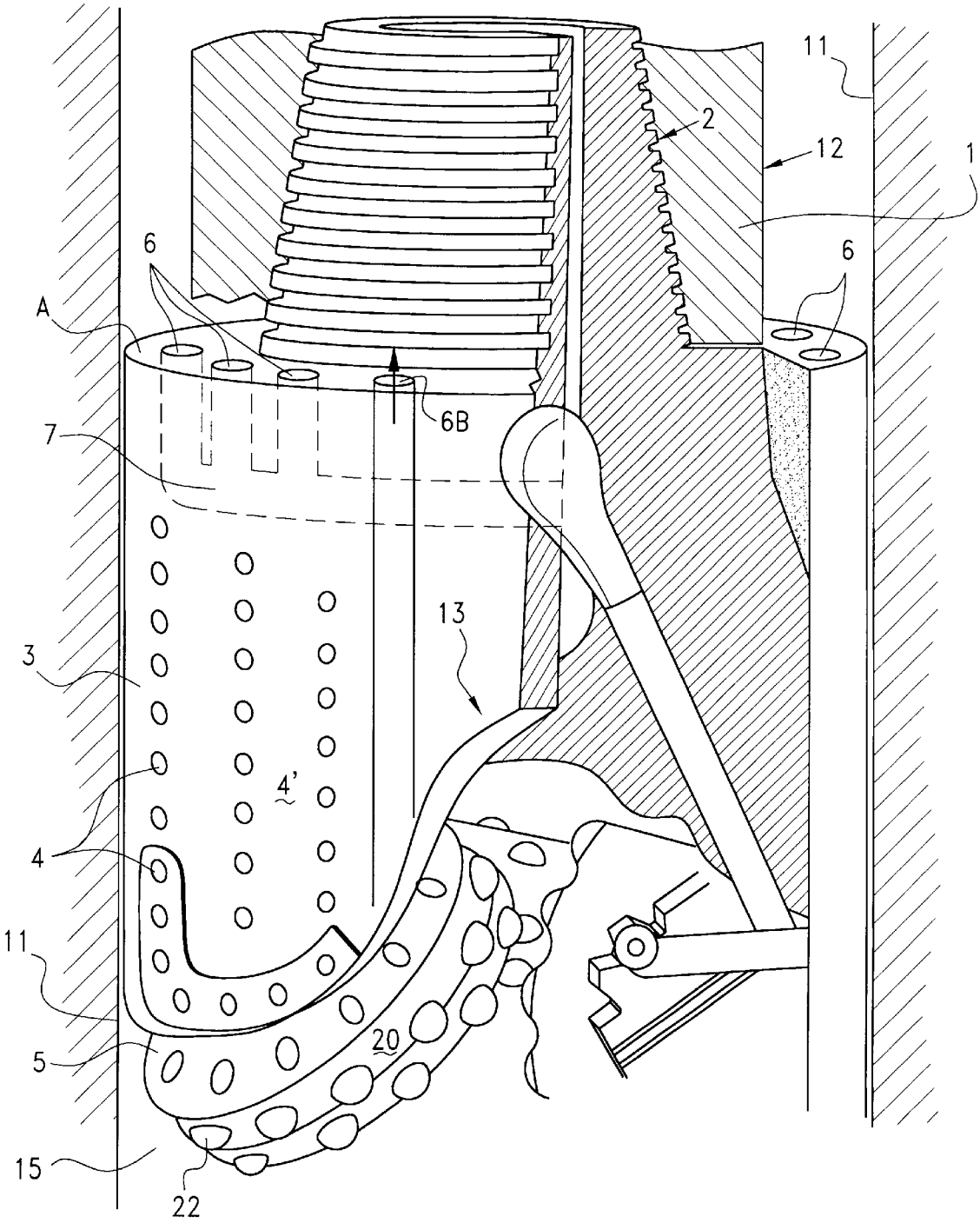
FIG. 1 is a perspective view of the drill bit in the drill hole with the stabilizer upper openings or nozzles threadably coupled to the drill string.
Figure 5:
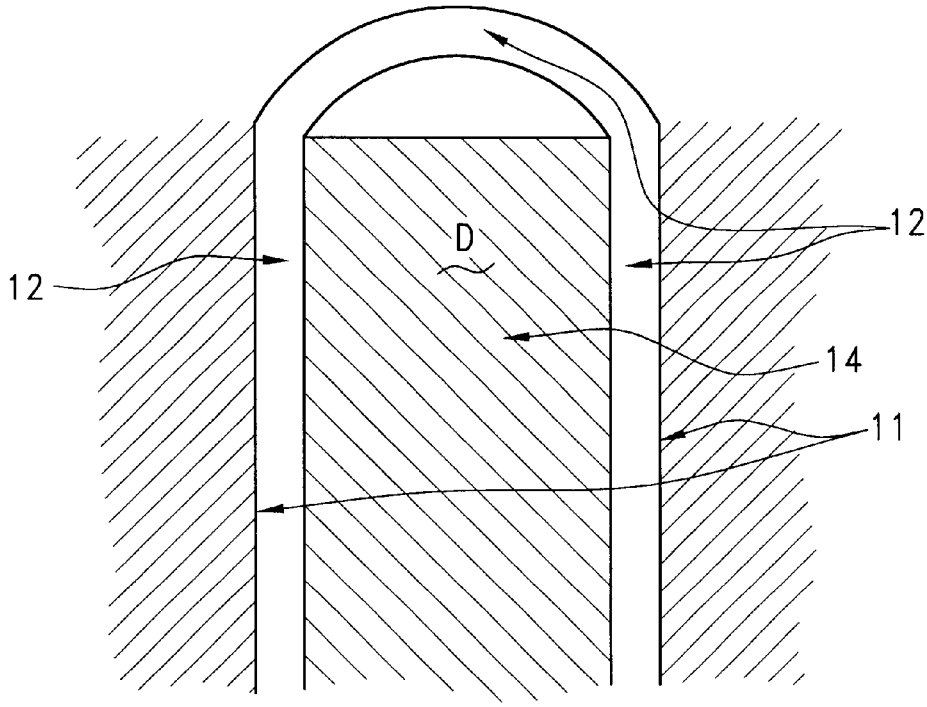
FIG. 5 shows the annular area around the drill string in the bore hole.
Figure 6:
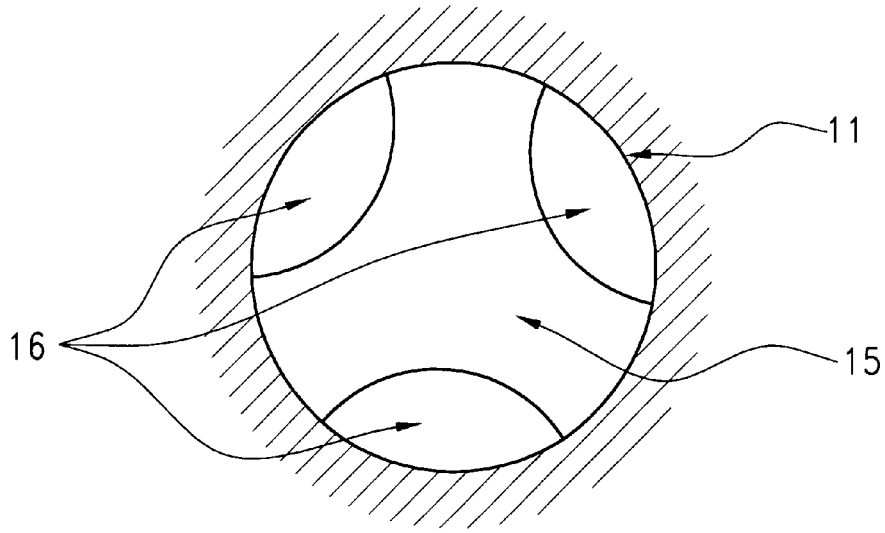
FIG. 6 shows reduced annular area in the drill bit bottom of the hole area.

Turning now in more detail to the drawings, FIG. 1 shows a drill bit 2 attached to a drill located in a drill hole 11 having its own bit stabilizer 3 having a plurality of replaceable wear resistant inserts 4 and hard surfacing 4 to protect the cutting cones from excess wear and eliminating the need for a prior art separate bit stabilizer used between the drill bit 2 and the drill string 1. Located at the upper end shoulder A of the stabilizer 3 is strategically located a series of adjustable openings or nozzles 6. The openings or nozzles 6 are directed up hole D in the drill pipe 14, FIG. 5, and drill hole 11 annular area 12 in such a way as to form a fluidized bed to convey dust and cuttings to the surface of the bore hole. The openings or nozzles 6 are adjustable to regulate the amount of pressurized fluid delivered from the drill through the hollow drill string 14, FIG. 5, to the drill bit plenum chamber 17, FIG. 3, and by port 7 to the upper openings or nozzles 6. The left opening or nozzle 6A is tilted to the left side B of the drill bit, FIG. 3. The right side opening or nozzle 6A is tilted to the right C and the center opening or nozzle 6B points straight up. Located between cutting cones 5 is an adjustable opening or nozzle 9, FIG. 2, directed to the bottom of the drill hole 15, FIG. 2, to convey dust and cuttings via the annular area 13, FIG. 2, to the upper end A of the bit stabilizers. The opening or nozzle 9, FIG. 2, receives pressurized fluid medium from the bit plenum chamber 17, FIG. 3, and is metered by the adjustable opening or nozzle 9, FIG. 2, to deliver only that volume of pressurized fluid medium necessary to develop only that velocity required to convey the dust and cuttings from the cutting cones 5, FIG. 1, and the bottom 15 of the drill hole 11, via the bit annular areas 16, FIG. 6, and effectively eliminate substantial excess wear on the cutting cones 5, cutting structure 20 and teeth 22, FIG. 1, and to the bearing skirt.

The nozzles 6 and 9 are preselected by the user and are removably secured in the shoulder A and between the cutting cones 5, respectively, before the drill bit is lowered into the drill hole 11. The openings or nozzles 6 and 9 each have different characteristics and are chosen to cause a difference in volume of fluid between the bottom of the drill bit and the bottom of the drill hole and the volume of fluid at the shoulder area thereby imparting velocity to the dust and cuttings to enhance the discharge of the same up the drill hole.

The selected nozzles are chosen by the user who is experienced and skilled in the art and who knows the characteristics needed based on the size and weight of the drill bit and the soil being drilled, the depth of the hole, etc.

The volume of fluid is of a certain volume and pressure to prevent regrind of the cuttings into the cutting cones thus significantly reducing damage thereto. This certain volume and pressure is sufficient to raise the fluid and cuttings to the shoulder whereat the pressure from the shoulder openings or nozzles raises the fluid and cuttings to the surface.

The user has an assortment of nozzles from which to choose to obtain the desired results, i.e., fluid size openings, length, etc.

Figure 2:
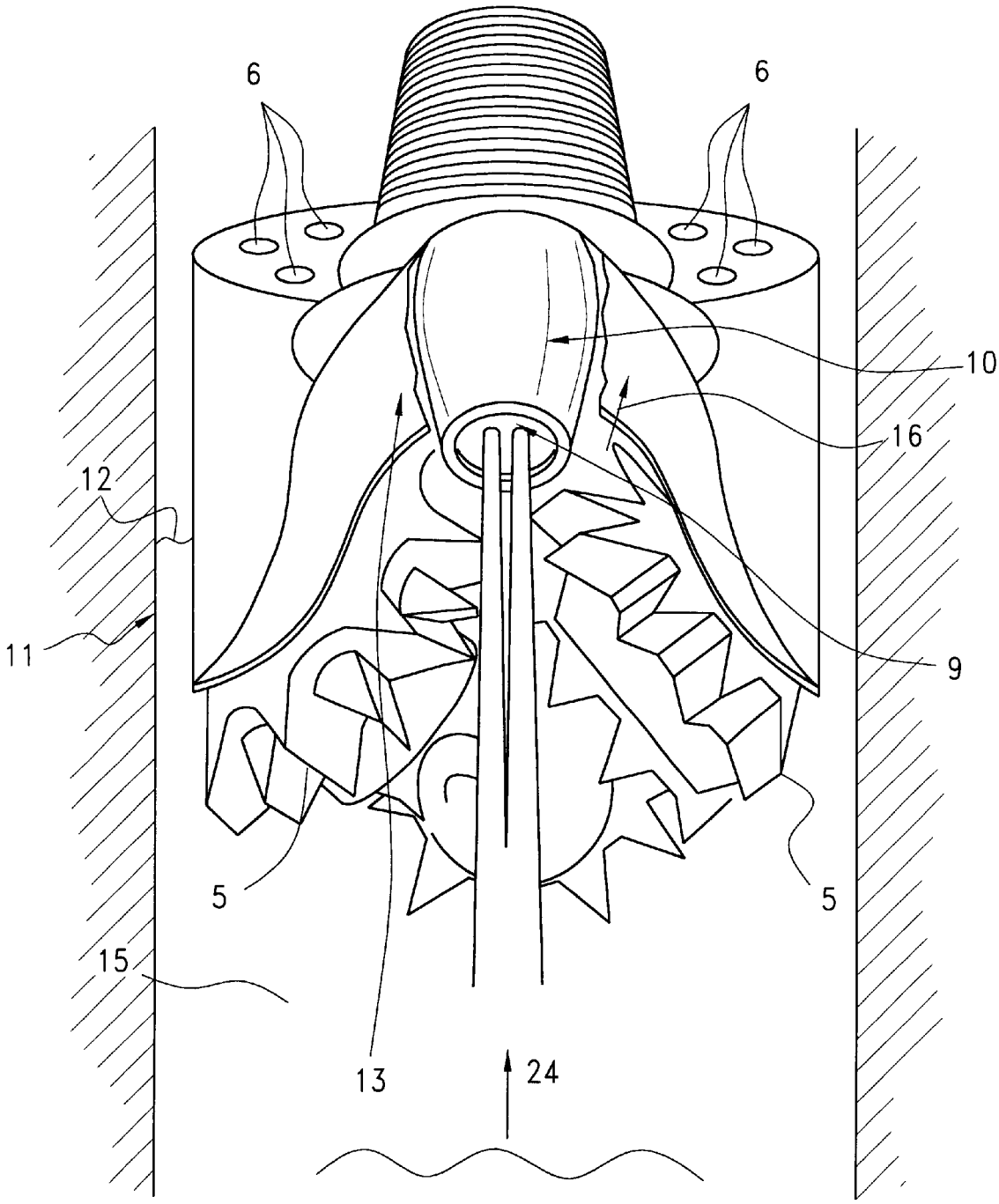
FIG. 2 shows the upper openings or nozzles located in the stabilizers and the lower opening or nozzle between the cutting cones.
Figure 3:
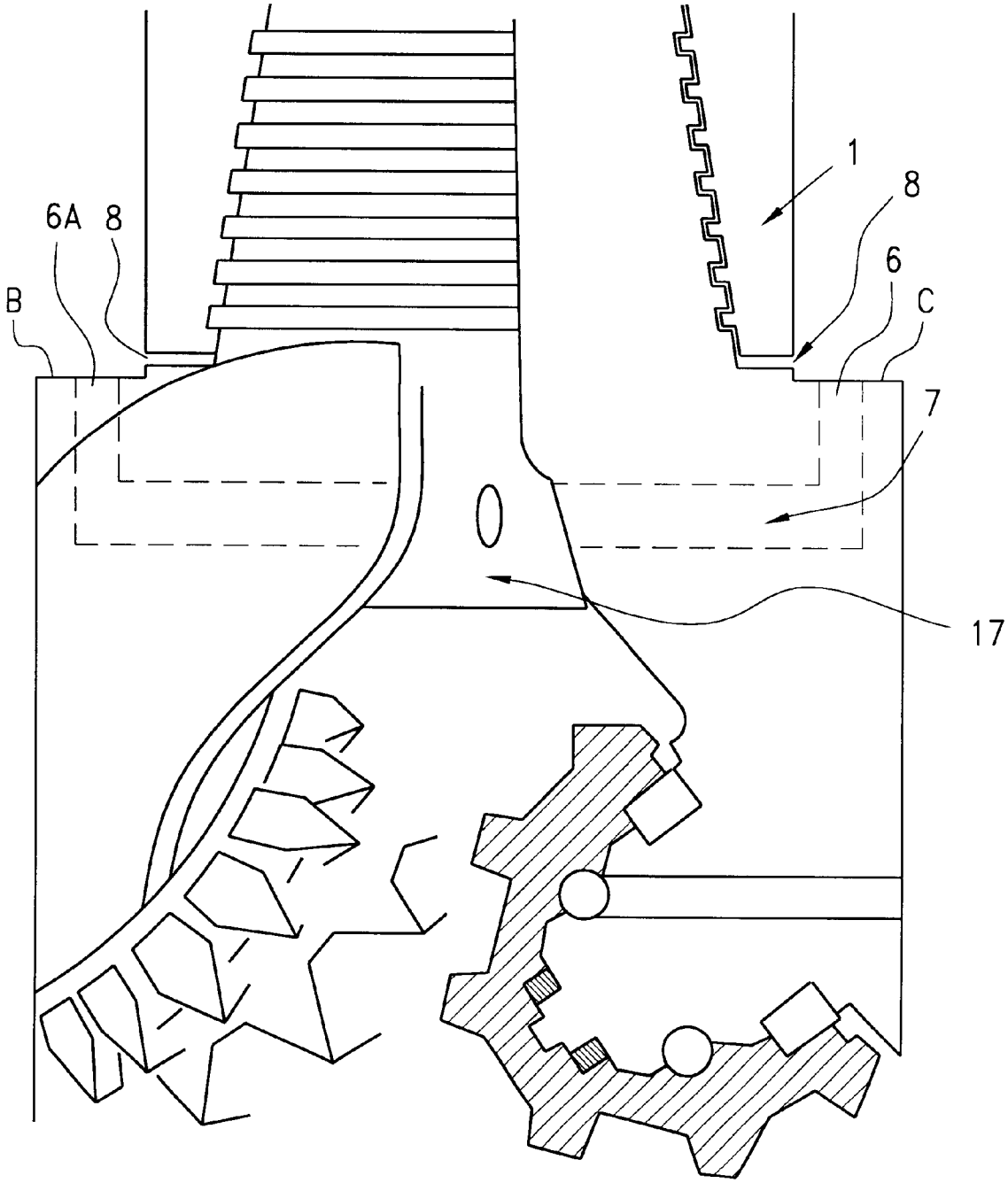
FIG. 3 shows the plenum chamber porting to the upper openings or nozzles and shoulder diameter of the drill bit being equal to that of the drill pipe.
Figure 4:
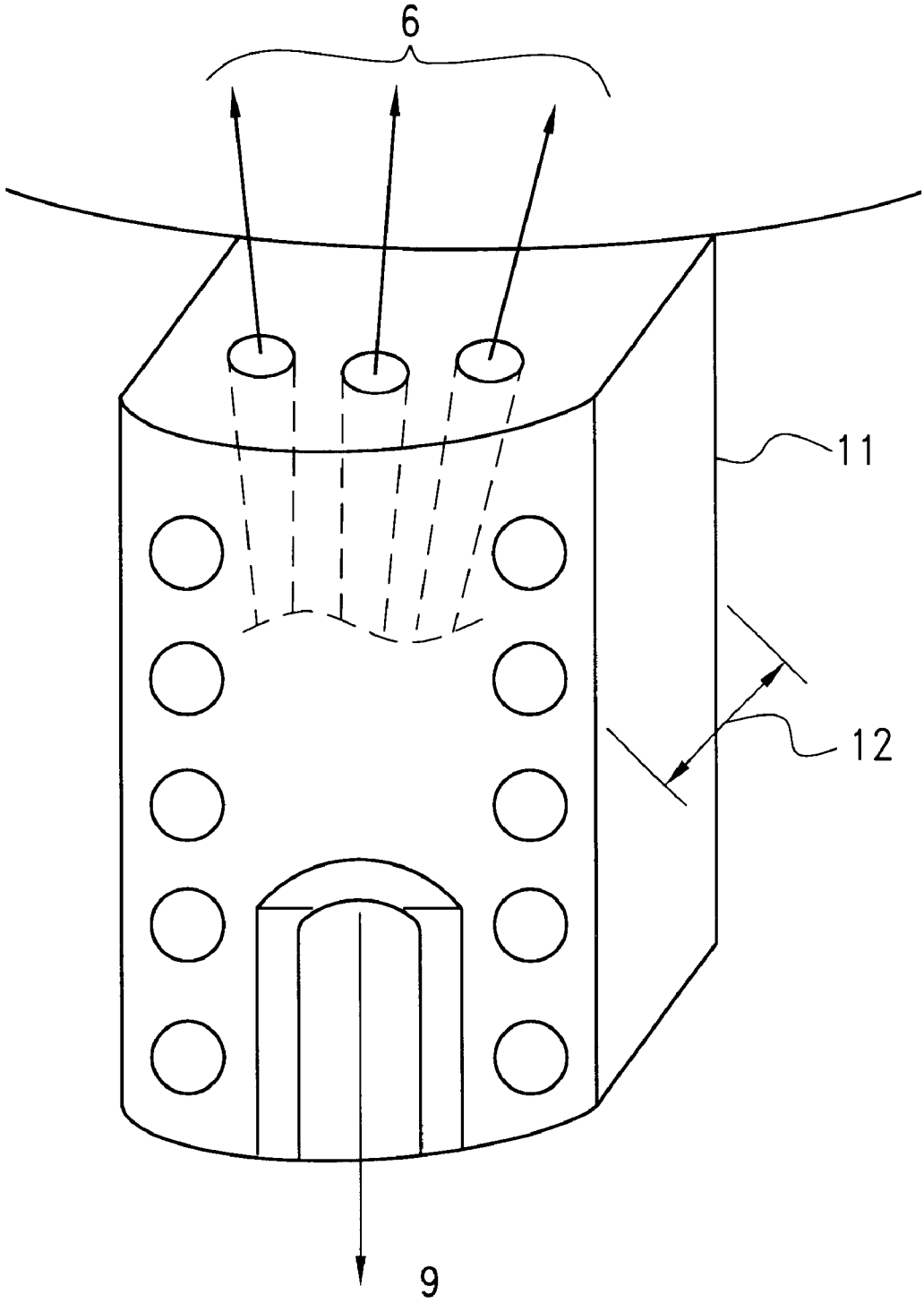
FIG. 4 shows an optional means of having upper and lower openings or nozzles by extending the lower nozzle to the bit shoulder to form a stabilizer with multiple adjustable openings or nozzles.

When you compare the annular area 13 and 16 in the bit area 24, FIG. 2, and the annular area 12 in the drill pipe hole 11, FIGS. 1 and 2, it is apparent to those skilled in the art that less volume is required in a smaller annular area than in a larger annular area to create the necessary velocity to convey dust and cuttings to the surface. It is also apparent to those in this industry that excessive velocity than is required results in regrind of cuttings and excess wear from erosion to any part subjected to the excessive velocity.

I claim:

1. A drill bit for drilling bore holes into earth formations comprising:

an upper body for attaching the drill bit to a drill string and a lower body having cutting means and a shoulder therebetween;

stabilizer means having wear-resistant inserts;

means to meter pressurized fluid to the stabilizer means and the bore hole for cuttings removal;

said means including a plurality of adjustable and removable nozzles to regulate the amount of said pressurized fluid delivered to the drill hole;

said nozzles being removably secured on the shoulder and on the cutting means whereby said pressurized fluid is balanced in such a manner as to facilitate removal of the cuttings from the bottom of the drill bit and to create a fluidized bed of said fluid near the upper shoulders of said upper body for alleviating pressure at the bottom of the bore hole and facilitating removal of the cuttings up the bore hole.

2. The drill bit of claim 1 wherein said wear-resistant inserts have reinforced means to minimize reduction grind, sand blast and erosion whereby the drill bit has a longer life due to minimum regrind of sand blast and erosion.

3. The drill bit of claim 1 wherein said drill bit has a plenum chamber for receiving the pressurized fluid and the chamber is ported to deliver said pressurized fluid to said shoulder and bit nozzles.

4. The drill bit of claim 3 wherein said at least one nozzle is in a series of vertically oriented nozzles.

5. The drill bit of claim 4 wherein said wear-resistant inserts are on the surface of the drill bit and are removably secured thereto.

6. The drill bit of claim 1 wherein said shoulder and said bit nozzles are preselected to deliver a volume of pressure to create only a velocity necessary to convey the dust and cuttings upwardly of the bore hole.

7. The drill bit of claim 6 wherein said drill bit has a plenum chamber for receiving the pressurized fluid and the chamber is ported to deliver said pressurized fluid to said shoulder and bit nozzles.

* * * * *